US006868968B1

(12) United States Patent
Casanovas

(10) Patent No.: US 6,868,968 B1
(45) Date of Patent: Mar. 22, 2005

(54) STACKABLE TRAY FOR TRANSPORT OF FRUIT AND HORTICULTURAL PRODUCTS

(76) Inventor: Pedro Teixidor Casanovas, Carretera Palmlona-Aoiz, Km. 4,300, Ibiricu de Egues, Navarra E-31486 (ES)

( * ) Notice: Subject to any disclaimer, the term of this patent is extended or adjusted under 35 U.S.C. 154(b) by 0 days.

(21) Appl. No.: 10/030,889

(22) PCT Filed: May 7, 1999

(86) PCT No.: PCT/ES99/00125

§ 371 (c)(1),
(2), (4) Date: Aug. 21, 2002

(87) PCT Pub. No.: WO00/68097

PCT Pub. Date: Nov. 16, 2000

(51) Int. Cl.[7] ..... B65D 5/20
(52) U.S. Cl. ..... 206/509; 229/164; 229/191
(58) Field of Search ..... 206/557, 512, 206/503, 509, 521, 521.1; 229/164, 167, 168, 174, 191

(56) References Cited

U.S. PATENT DOCUMENTS

| | | | | | |
|---|---|---|---|---|---|
| 4,470,339 | A | * | 9/1984 | Tardy | 91/420 |
| 5,285,956 | A | * | 2/1994 | Piepho | 229/191 |
| 5,452,848 | A | * | 9/1995 | Mur Gimeno | 229/191 |
| 5,535,941 | A | * | 7/1996 | Garza | 229/191 |
| 5,735,405 | A | * | 4/1998 | Vila | 206/511 |
| 6,186,393 | B1 | * | 2/2001 | Tsamourgelis | 229/122.26 |
| 6,378,764 | B1 | * | 4/2002 | Teixidor Casanovas | 229/191 |
| 6,651,875 | B2 | * | 11/2003 | Chu | 229/191 |
| 6,676,012 | B1 | * | 1/2004 | Southwell et al. | 229/120.17 |

FOREIGN PATENT DOCUMENTS

| | | |
|---|---|---|
| EP | 0 538 098 A1 | 4/1993 |
| EP | 0 573 381 A1 | 12/1993 |
| EP | 0 785 136 A1 | 7/1997 |
| GB | 964940 | 7/1964 |
| GB | 2019360 | 10/1979 |
| WO | WO 98/00344 | 1/1998 |
| WO | WO 98/25830 | 6/1998 |

* cited by examiner

*Primary Examiner*—Jim Foster
(74) *Attorney, Agent, or Firm*—Welsh & Katz, Ltd.

(57) ABSTRACT

The tray comprises five independent parts which with the suitable construction and attachment to each other define the base (1), side walls (2) and end pieces (3), with the part corresponding to the latter provided with extreme extensions provided in each case with the folding line which gives rise to sectors (8), (9), (10), (11) and (12) which fold so that they superimpose on each other in an enveloping manner, forming triangular-prism shaped reinforcements at the corners, which reinforcements are provided, on either side of the corner and in correspondence with the upper edge of the corners, with ridges (15) complementary of slits (5) of the bottom of the tray, in order to stack the trays on each other. Said reinforcements which are part of end pieces (3) are formed before the parts reach the assembly station of the tray itself, which is meant to contain fruit and similar products.

5 Claims, 6 Drawing Sheets

STACKABLE TRAY FOR TRANSPORT OF FRUIT AND HORTICULTURAL PRODUCTS

OBJECT OF THE INVENTION

The invention relates to a stackable tray for transport of fruit and horticultural products, made from compact cardboard as raw material, and which may be formed from a single block or from five independent die-cut parts provided with cutting and folding lines, suitably attached to each other with adhesives. Either embodiment provides a tray of great resistance to stacking and to possible impacts which it may receive, as well as to compression loads and capable of withstanding considerable humidity without deterioration.

The object of the invention is to provide a stackable tray which, based on a construction in a single piece or in five independent parts suitably shaped, presents special characteristics as regards the folding of the extensions which form the box reinforcements in its corners, specifically in its internal dihedral, as well as regards the means which provide a stable stacking with identical trays.

BACKGROUND OF THE INVENTION

Corrugated cardboard boxes are provided with prismatic reinforcements which despite their triangular shape result in a loss of useful space in the box, as the face corresponding to the triangle's hypotenuse faces inwards, occupying considerable space.

Additionally, invention patent P 9602617, of the same applicant, describes a stackable tray for transport of perishable products and the like consisting of five independent compact cardboard parts, duly die-cut, which comprise the base, the two greater side walls the corresponding end pieces, so that the base part is provided with four slits corresponding to the corners between which a folding line allows to place upright on the base part, small vertical extensions to which are glued the side walls and end pieces, so that the parts which make up the side walls have end extensions which occupy half of each end piece, thereby forming a double wall with the independent end piece part.

Furthermore, traditional corner reinforcements are obtained by an enveloping folding of a number of sectors defined by transverse folding lines which are extensions of the end pieces, such that this enveloping construction of the reinforcements results in rectangular prisms formed by double and triple walls which envelop each other, as stated before.

However, although the box described in said P 9602617 has a considerable resistance to both stacking and humidity, and is efficient in its function, it suffers from two problems and disadvantages, namely that the prism reinforcements of the corners are obtained at the same station as the assembly and gluing of the box, and that said prism reinforcements, due to their enveloping triangular shape, occupy a considerable space which results in a corresponding reduction in the box capacity.

Naturally, if the corner reinforcements arrived at the box assembly station already formed, the production rate would increase, while for the second case it would be desirable to minimise the volume occupied by the prismatic corner reinforcements.

In addition, said tray or box also loses internal capacity due to the considerable size of the reinforcement surface corresponding to the hypotenuse of each rectangular prism in each corner reinforcement.

DESCRIPTION OF THE INVENTION

The tray disclosed has been designed to solve the above described problems, that is, to improve the box object of invention patent P 9602617, based on improvements which are hereunder described.

The first improvement object of the invention involves the prismatic corner reinforcements, which instead of being obtained in an enveloping form are obtained by superposition of sectors which successively fold and which are separated from each other by corresponding cut and fold lines, furthermore allowing the hypotenuse of the triangular shape of the reinforcements to be considerably smaller, providing a greater use of the inner tray volume.

A further improvement consists of the tray being provided with trapezoidal ridges at the corners, specifically two at each corner in the invention, one at the end piece and one at the side wall, requiring only two orifices or slits on the bottom to provide a stable stacking of the trays, which stacking is aided by a considerably longer ridge provided in each end piece after the trapezoidal ridge, which as the former ones inserts in a rectangular orifice provided for such purpose in the bottom of the tray.

The aforementioned trapezoidal ridges which project out of the end pieces and side walls next to the corners, are double, in the sense that they are part of the outer and inner walls, providing sturdy ridges, unlike those of conventional trays in which such ridges are simple and generally provided only on the outer wall.

The extensions comprising the folding sectors which form the corner reinforcements have four transverse folding lines determining five sectors, so that the first two with different size overlap each other perpendicular to the end piece which they are part of, while the intermediate sector is perpendicular to the corner diagonal, so that the last to sectors which are also different in size overlap each other and are adjacent to the inner face of the corresponding end piece, as the two first pieces are superimposed on the end of the greater side wall of the box.

Thus, as mentioned before, the corner reinforcements are reduced in volume, and more importantly the reinforcements arrive assembled at the station where the tray is assembled, which obviously increases production since no time is lost in forming the reinforcements as they are already formed, unlike in the traditional process.

Additionally, the tray of the invention by virtue of the construction of said reinforcements is more resistant to compression loads.

In an alternative embodiment said ridges provided on the corner reinforcements, instead of being placed on the top edge of the end pieces or of the side walls, next to the corners, are made in the upper edge of the triangular prism shaped reinforcement itself, in which case the ridges are also double as the last sector of the end extension of the side walls continues after the corresponding folding line in another sector which is attached on the intermediate one, forming a double wall in the hypotenuse and in said double wall, in correspondence with the upper edge are the double ridges allowing a stable stacking of the trays. Naturally in this case the lower end of the sector corresponding to the hypotenuse and the bottom of the tray have slits which allow positioning and insertion of said ridges when trays are stacked.

The tray with the aforementioned characteristics may be obtained from a single body piece or sheet with suitable cut and fold lines to obtain a tray which, although lacking the resistance of the above described tray, does provide sufficient resistance for certain applications, with the sheet from which the tray is obtained in this alternative single-piece embodiment naturally also made of compact cardboard.

DESCRIPTION OF THE DRAWINGS

These and further characteristics of the invention will be more clearly understood in view of the accompanying drawings where for purposes of illustration only the following is shown.

PREFERRED EMBODIMENT OF THE INVENTION

Figure 1:
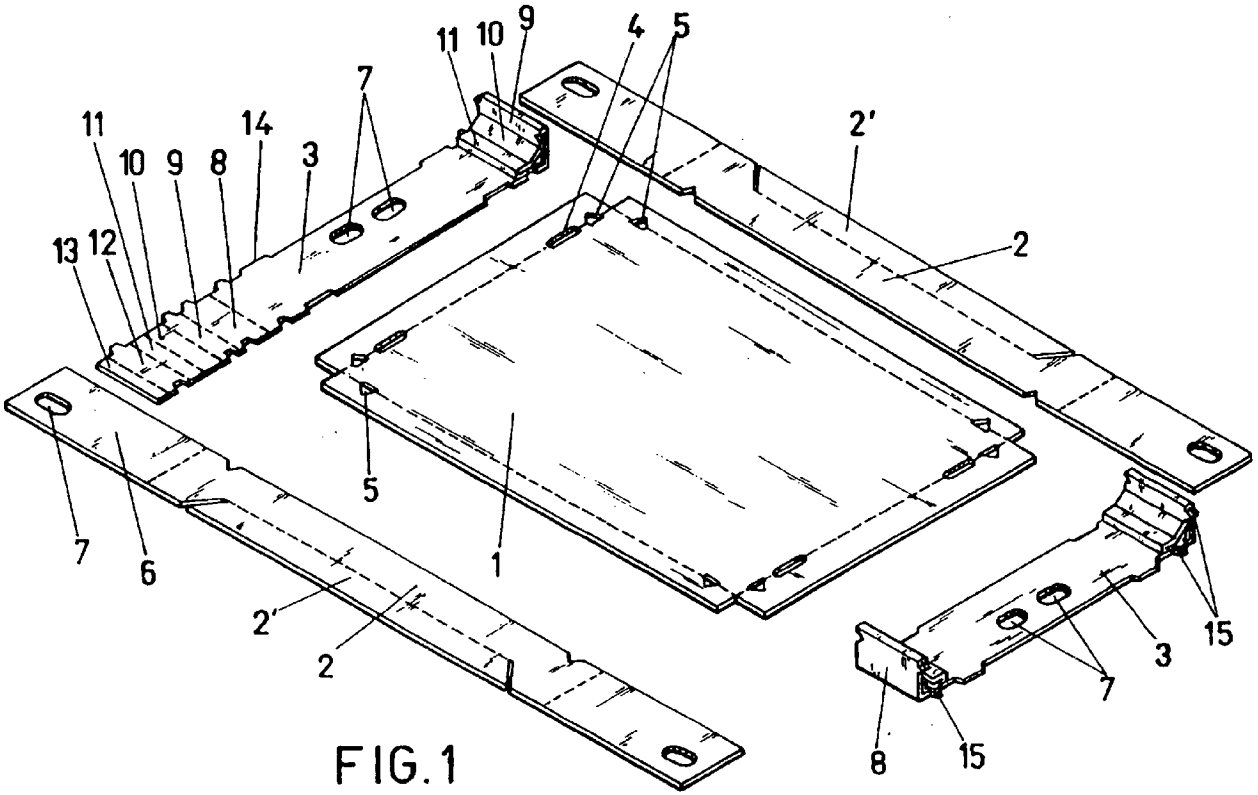
FIG. 1.—Shows a perspective view of the basic elements from which the tray of the invention is obtained.
Figure 2:
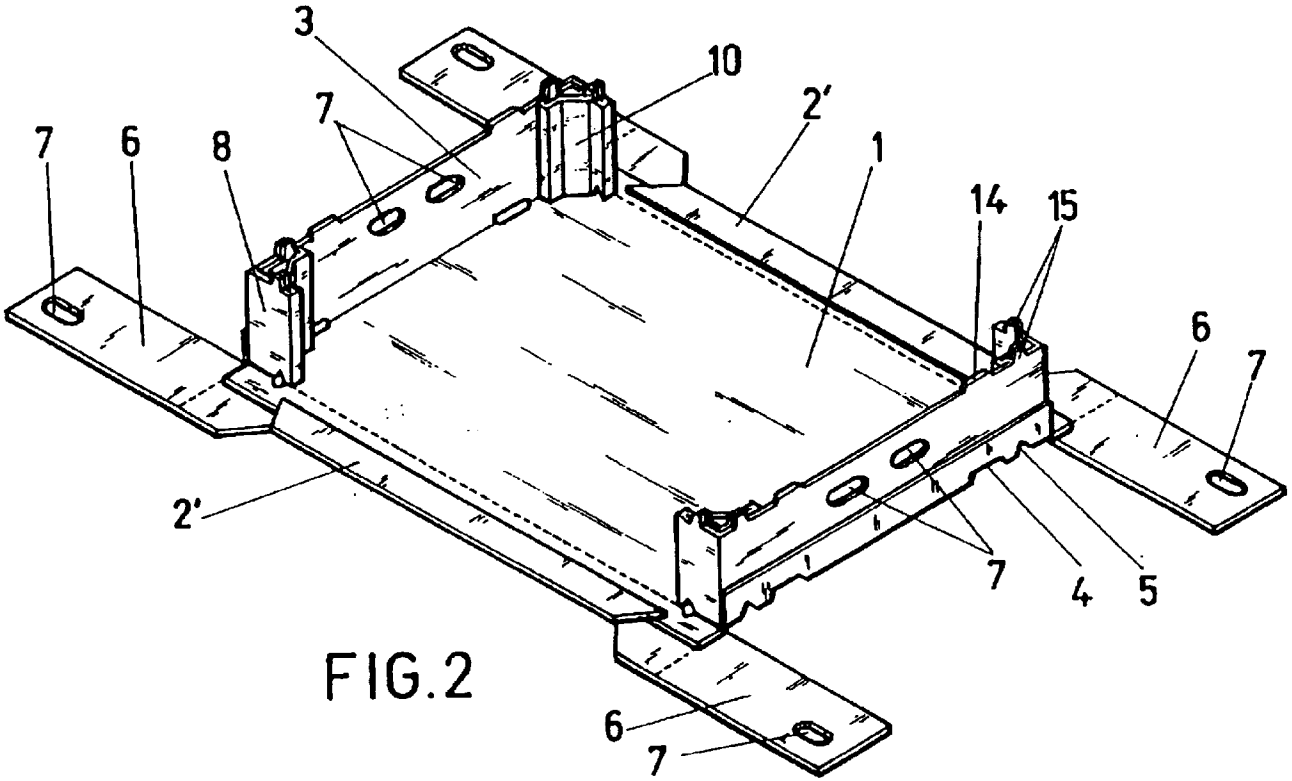
FIG. 2.—Shows a perspective view of the tray in an initial assembly stage.
Figure 3:
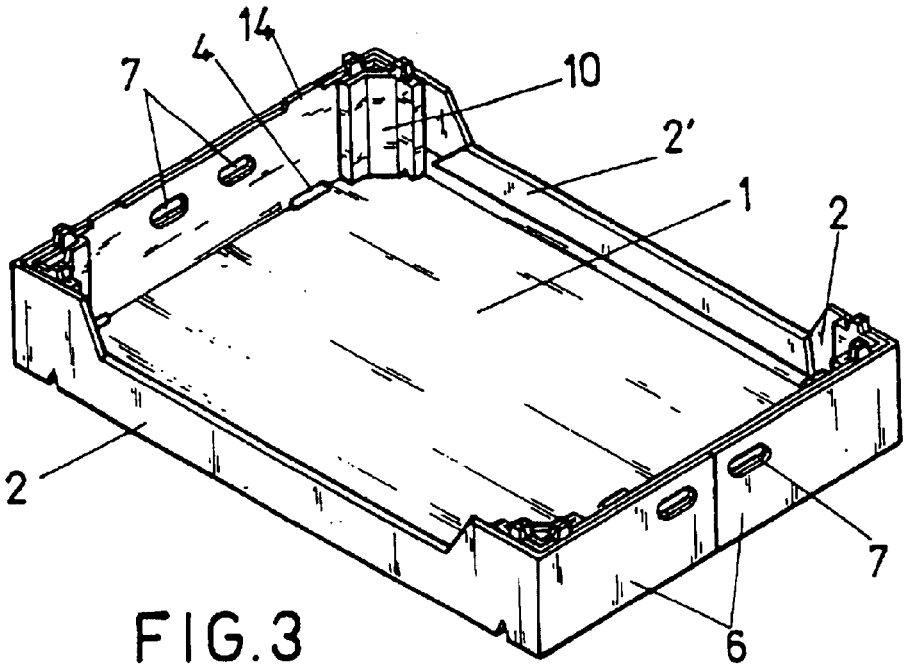
FIG. 3.—Shows a perspective view of the fully assembled tray with its various parts duly glued.

As may be seen in the figures, the tray of the invention is obtained by attaching to each other five parts, one of which forms the base (1), another two form the greater side walls (2), which have a longitudinal folding line above their mid-height, defining a longitudinal extension (2') which folds inwards and is left adjacent to the inner face of side wall (2), forming a reinforcement of said wall, with the tray completed by a further two pieces (3) which make up the end pieces, so that both the parts which correspond to the side walls (2) and those corresponding to the end pieces (3) are attached to the base (1) by extensions of each side of said base (1), which extensions project vertically upwards during the assembly stage, along a plane perpendicular to base (1), in order to allow the vertical attachment of said side walls (2) and end pieces (3).

Base (1) is provided with a pair of elongated openings (4) in correspondence with each end piece, as well as with pairs of slits (5), one corresponding to the end piece and another with the bottom edge of the test pieces and side walls, next to the corresponding corner, whose function shall be described below.

Parts (2) which make up the side walls are prolonged in extensions (6) which are exactly half the size of that of each end piece (3), so that said end extensions (6) of sides (2) are placed on the external surface of each end piece (3) and attached by glue, defining a double wall for each end piece provided with a pair of openings (7) which define handles for the tray.

On their part, parts (3) which define the inner wall of the end pieces are provided with end extensions in which are made a number of transverse folding lines which give rise to at least five sectors, (8), (9), (10), (11) and (12), so that successive folding of said sectors creates the corresponding corner reinforcements. Specifically, sector (8) using a first folding line is placed perpendicular to said end piece (3), then folding and superimposing sector (9) on the inner face of sector (8), with sector (9) being smaller, so that the perpendicular position of sector (8) with respect to end piece (3) means that the former is superimposed on the inner face of the respective side wall (2). Likewise, sectors (11) and (12), which have different sizes, are placed next to each other and larger sector (12) is superimposed on the inner face of the respective end piece (3), with intermediate sector (10) placed perpendicular to the diagonal of the corresponding corner, thus forming in each corner the corresponding prism shaped reinforcement, in which the sectors instead of being placed enveloping as is conventional are superimposed or folded, so that only the intermediate sector is oblique with respect to the corners.

Figure 4:
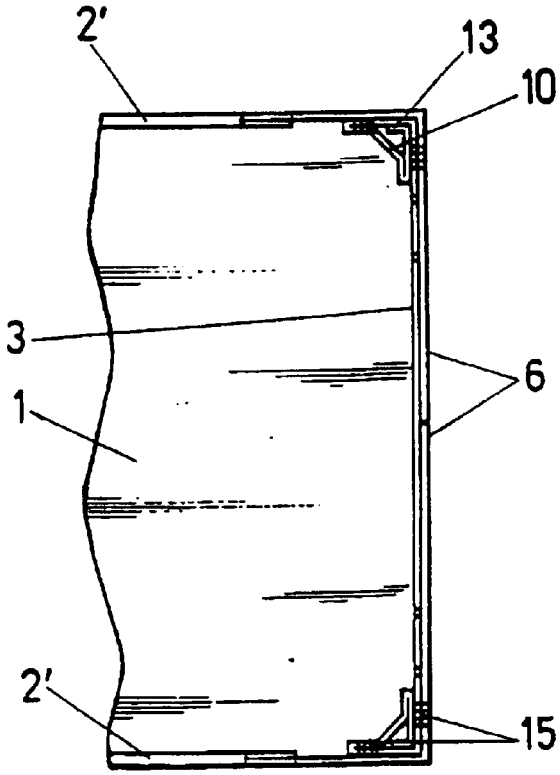
FIG. 4.—Shows a plan view of an end segment of the assembled tray showing the full configuration of the corner reinforcements.

As an option sector (12) may be followed by an additional sector, (13), which in assembly would be superimposed to the inner face of the end segment of initial sector (8), specifically between the end of sector (9) attached to sector (8) and the corner, as shown clearly in FIG. 4.

End pieces (3) arrive at the tray assembly station with their reinforcements already formed, thereby increasing production, i.e. reducing the time required to assemble the tray. Furthermore, the construction based on superposition of the various reinforcement sectors implies a notable reduction of these and therefore an increased capacity of the tray, in addition to the increased resistance to compression loads to which the tray may be subject to when loaded with fruit or similar products.

In addition to the properties described, the tray described above is provided with means which allow a stable stacking of such trays as one of its main characteristics. For this purpose, the ends of end pieces (3) are provided with long flanges (14) and in correspondence with the reinforcements with trapezoidal ridges (15), the former inserting in openings (4) of the bottom of the tray and the latter inserting in openings or slits (5) also on the bottom of the tray, in correspondence with such reinforcements, so that by means of said flanges (14) and ridges (15) inserting in openings (4) and slits (5) the trays stack in a stable and correct arrangement.

As may be inferred said trapezoidal ridges (15) are double, as they are part of the top edge of the two walls which concur in each corner, and more importantly, the ridges are placed both on the top edge of the end pieces and on the top edge of the side walls, providing greater sturdiness to these ridges which will prevent their deterioration during use of the trays.

Figure 5:
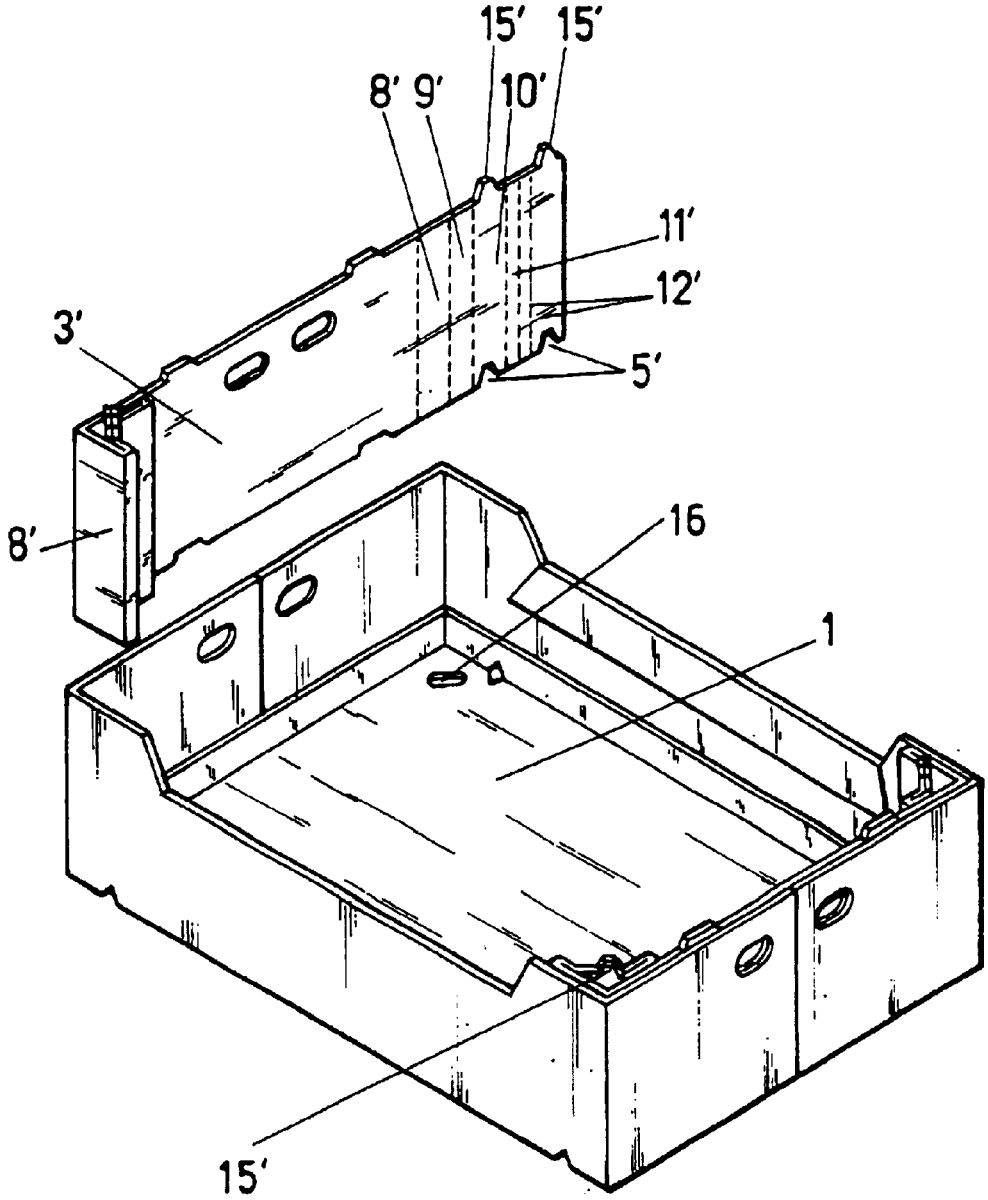
FIG. 5.—Shows the tray in an incomplete assembly stage, which tray corresponds to an alternative embodiment of the reinforcements.

In an alternative embodiment shown in FIG. 5 the end extensions of end piece wall (3') in each case comprise sectors (8'), (9'), (10'), (11') and (12'), so that the trapezoidal ridges (15') are made on the upper edge of sectors (10') and (12°), while the lower edge of said sectors (10') and (12') are provided with a slit (5') complementary of ridges (15').

When forming the prism shaped corner reinforcements in this second alternative embodiment, sector (12') is placed next to the inside of sector (10'), forming a double wall perpendicular to the corner diagonal, i.e. forming the hypotenuse of the right angle corresponding to each corner reinforcement prism.

This superposition of sectors (10') and (12') implies that ridges (15') are also superimposed on each other, forming a double ridge on the top edge of the reinforcement prism hypotenuse so that when stacking said double ridge (15') will be inserted in double slit (5') provided on the bottom of sectors (10') and (12'). In addition, on the bottom of the box is naturally provided a diagonal opening (16) allowing passage of said double ridges (15).

Figure 6:
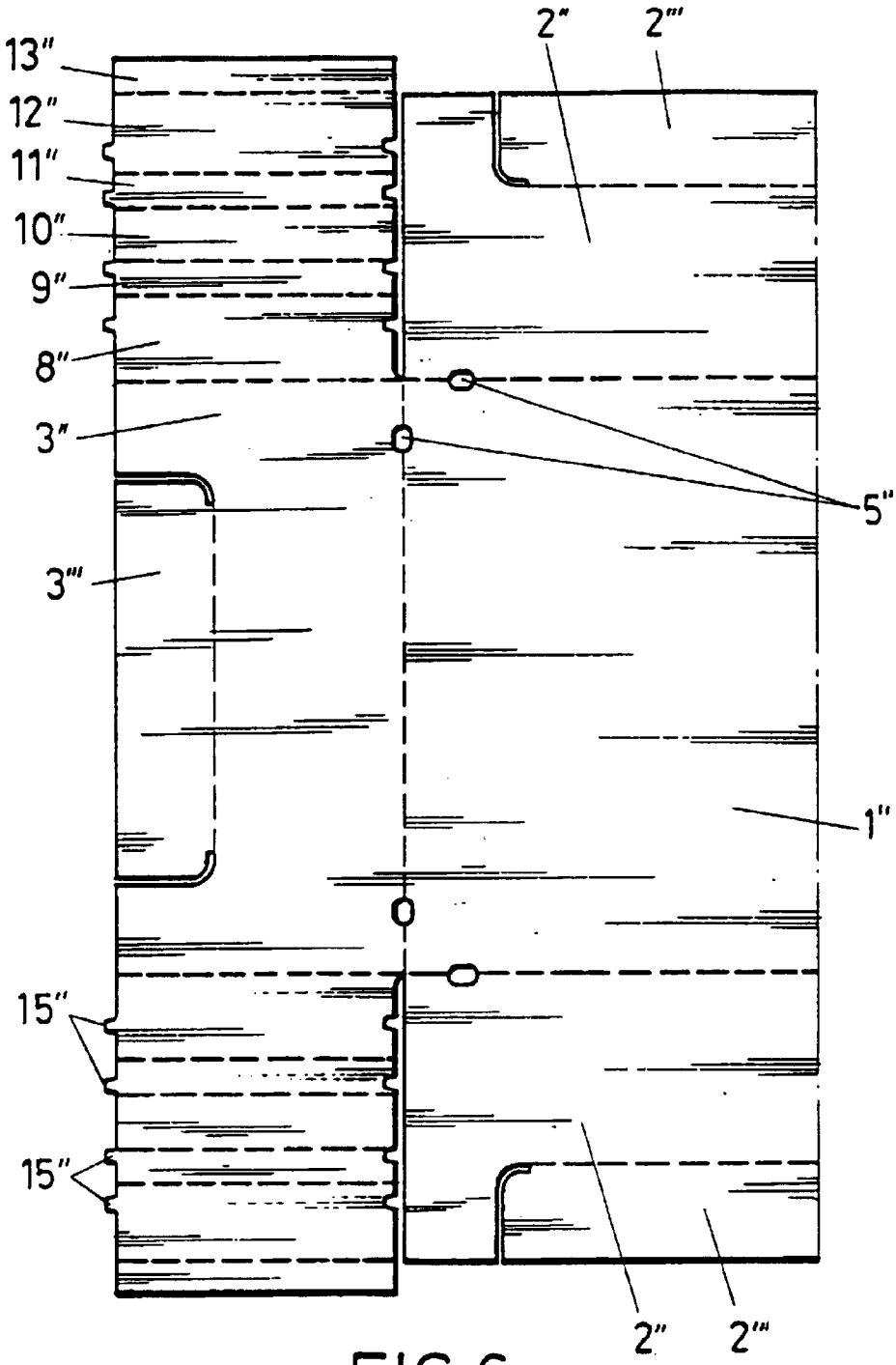
FIG. 6.—Shows the layout of a sheet, as a single piece of compact cardboard, from which is obtained a tray of similar characteristics to that of preceding embodiments.
Figure 7:
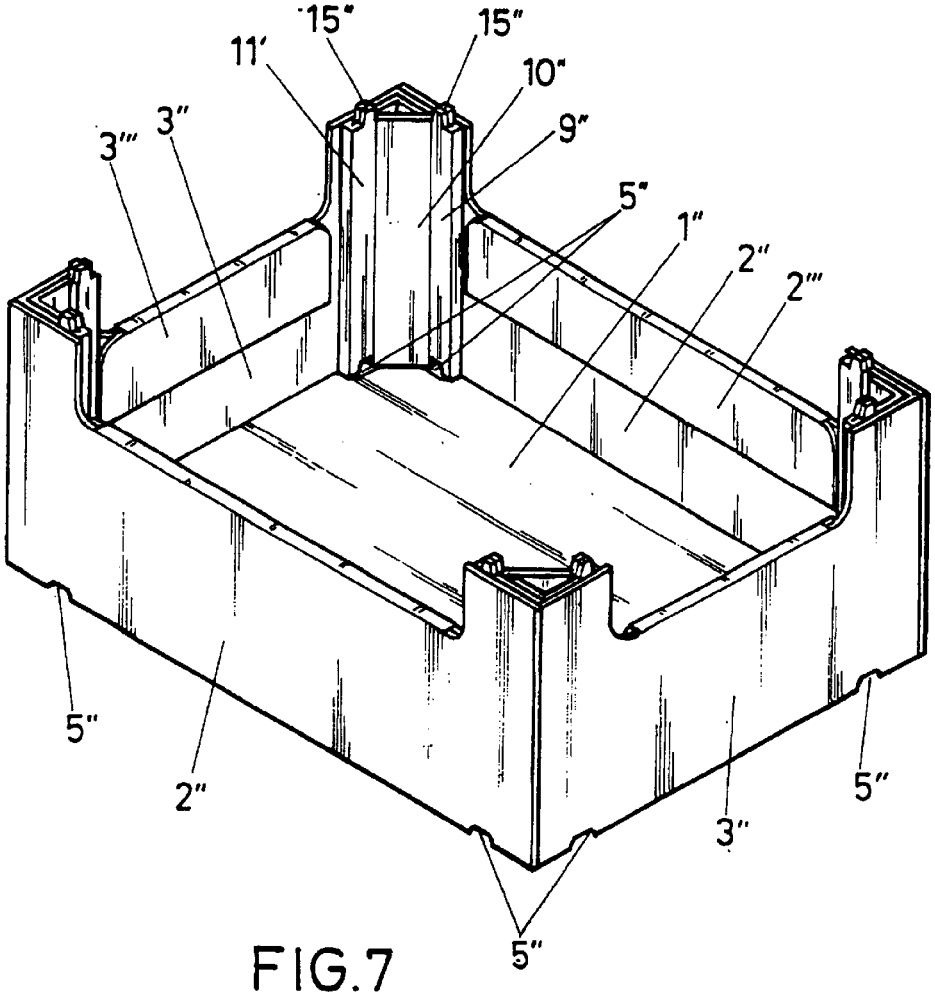
FIG. 7.—Finally shows a perspective view of the tray obtained from the sheet shown in the previous figure.

In an alternative embodiment shown in FIGS. 6 and 7 the tray is obtained from a single sheet of compact cardboard with the corresponding cutting and folding lines, obtaining a tray with similar characteristics as those described above.

In this alternative embodiment, sector (1") which will form the base is extended in side walls (2") and end pieces (3") which form the side walls and end pieces respectively, by folding inwards extensions (2'") and (3'") of the extensions which correspond to sides (2") and end pieces (3").

In correspondence with the corners, specifically along the folding lines limiting the end pieces and the base are provided openings (5") whose purpose will be described below.

End pieces (3") present extensions on their ends, a number of transverse folding lines giving rise to six correlated sectors (8"), (9"), (10"), (11"), (12") and (13"), which successively fold on each other and define the corner reinforcements, where sectors (8") and (9") are superimposed on each other, with initial sector (8") attached to the inner face of the end of the corresponding side wall (2"), while sectors (11") and (12") are also superimposed on each other and sector (12") overlapping on the inner face of the end of the corresponding end piece, so that sector (13") is coplanar to sector (9") and attached to the inner face of sector (8"), while sector (10") is placed diagonally with respect to the prior sectors, that is, forming a hypotenuse of the triangular prism shaped reinforcement, in addition sunken inwards so that it allows a maximum internal capacity for the tray.

Sectors (9") and (11"), and even (8") and (12"), shall be provided with a trapezoidal ridge (15") which during assembly will project out of the top edge of the corner reinforcements, said ridges (15") comprising the means for centering trays when they are stacked as they are housed in openings (5") provided for such purpose in the tray immediately above.

What is claimed is:

1. Stackable tray for transport of fruit and horticultural products, constructed from a compact cardboard sheet in a single piece or by assembly of five pieces of compact cardboard, which define the base, greater side walls and end pieces, the last provided with prism-shaped reinforcements on the corners obtained by an enveloping construction of several sectors defined in an extension provided at each end of said end pieces, and further provided with means allowing the stable and correct stacking of trays, essentially characterised in that the end extensions of end pieces (3) are provided with folding lines which give rise to a first, second, third, fourth and fifth consecutive sections (8,9,10,11,12), where first sector (8) is larger than the second sector (9), with these sectors folded on each other and attached perpendicular to end piece (3) from which they originate, with first sector (8) attached by its external surface on the inner face of the corresponding side wall of the tray, while extreme fourth sector (11) and fifth sector (12), which also differ in size, are attached to each other through the external face of larger fifth sector (12) folded onto the inner face of the corresponding end segment of end piece (3), with third sector (10) remaining perpendicular to the diagonal of the corresponding corner; with double trapezoidal ridges (15) provided in correspondence with the upper edge of the concurrent prismatic reinforcements of each corner, said ridges created by upper extensions of both the inner and outer wall of said corner reinforcements, and where double upper ridges (15) are complementary of bottom openings or slits (5) provided for insertion of the former in the latter when the tray is stacked with other identical trays.

2. Stackable tray for transport of fruit and horticultural products as claimed in claim 1, characterised in that the extreme sector (12) of each end of the corners extends into an adjacent sector (13) which is attached by folding on the inner face of first sector (8), between the edge or corner of the box and the inner edge of sector (9) correlated and attached to the same sector (8).

3. Stackable tray for transport of fruit and horticultural products as claimed in claim 1, characterised in that end pieces (3) are provided next to their ends with elongated flanges (14) which upon stacking of the trays are inserted in openings (4) provided on the bottom of the trays, aiding in the stabilisation of the stack provided by ridges (15) defined in the corner reinforcements.

4. Stackable tray for transport of fruit and horticultural products as claimed in claim 1, characterised in that the prism-shaped corner reinforcements are formed by the superposed arrangement of five sectors (8'), (9'), (10'), (11') and (12'), with sectors (10') and (12') attached to each other, so that such sectors (10') and (12') are provided on their upper edge with trapezoidal ridges (15') complementary of slits (5') provided for such purpose on the lower edge, such that such that the bottom of the box is provided with complementary openings allowing ridges (15') to pass when the trays are stacked.

5. Stackable tray for transport of fruit and horticultural products, as claimed in claim 1, characterised in that it is obtained from a single sheet of compact cardboard with the corresponding folding and cutting lines which define a base (1"), side walls (2") and end pieces (3"), with extensions (2'") and (3'") respectively folded on the inner face of said side walls (2") and end pieces (3"), such that said end pieces are provided with extreme extensions with transverse folding lines which correlatively define six sectors (8"), (9"), (10"), (11"), (12") and (13"), with sectors (8") and (9") superimposed on each other and with sector (8") attached to the inner face of the extreme part of the corresponding side wall, while sectors (11") and (12") are equally superimposed on each other and with sector (12") attached to the inner face of the extreme end of end piece (3"), and extreme sector (13") placed coplanar to (9") and similarly attached to the inner face of sector (8"), with intermediate sector (10") defining a diagonal wall which corresponds to the hypotenuse of the triangular shape of each prism reinforcement created by the enveloping folding of such sectors, so that on base (1") and corresponding to the folding lines which limit base (1") and side walls (2") and end pieces (3") are provided openings (5") for insertion of ridges (15") provided in the upper edge of the prism-shaped corner reinforcements when trays are stacked on each other.

* * * * *